US009075376B2

(12) United States Patent
Utagawa et al.

(10) Patent No.: US 9,075,376 B2
(45) Date of Patent: Jul. 7, 2015

(54) AUTOMATIC DOCUMENT FEEDER AND IMAGE FORMING APPARATUS INCLUDING THE SAME

(71) Applicants: Hiroaki Utagawa, Kanagawa (JP); Hiroshi Kubo, Kanagawa (JP); Shinya Kitaoka, Kanagawa (JP); Takehisa Shimazu, Kanagawa (JP); Takeshi Akai, Kanagawa (JP); Fumiyuki Heishi, Kanagawa (JP); Norio Kimura, Kanagawa (JP); Yoshito Suzuki, Kanagawa (JP); Jun Yamada, Kanagawa (JP)

(72) Inventors: Hiroaki Utagawa, Kanagawa (JP); Hiroshi Kubo, Kanagawa (JP); Shinya Kitaoka, Kanagawa (JP); Takehisa Shimazu, Kanagawa (JP); Takeshi Akai, Kanagawa (JP); Fumiyuki Heishi, Kanagawa (JP); Norio Kimura, Kanagawa (JP); Yoshito Suzuki, Kanagawa (JP); Jun Yamada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 228 days.

(21) Appl. No.: 13/896,371

(22) Filed: May 17, 2013

(65) Prior Publication Data

US 2013/0315610 A1 Nov. 28, 2013

(30) Foreign Application Priority Data

May 28, 2012 (JP) ..... 2012-121163

(51) Int. Cl.
*G03G 15/00* (2006.01)

(52) U.S. Cl.
CPC ..... *G03G 15/607* (2013.01); *G03G 15/70* (2013.01)

(58) Field of Classification Search
CPC ..... G03G 2215/00341; G03G 15/60; G03G 15/70; G03G 15/607; H02H 3/202
USPC ..... 361/4–6
See application file for complete search history.

(56) References Cited

U.S. PATENT DOCUMENTS 3,692,401 A * 9/1972 Kawai ..... 399/411
5,953,553 A * 9/1999 Eto et al. ..... 399/17

(Continued)

FOREIGN PATENT DOCUMENTS

JP 2003-323086 11/2003
JP 2004148724 A * 5/2004 ..... B41J 29/13

(Continued)

*Primary Examiner* — Matthew G Marini
*Assistant Examiner* — Quang X Nguyen
(74) *Attorney, Agent, or Firm* — Harness, Dickey & Pierce, P.L.C.

(57) ABSTRACT

According to an embodiment, an ADF includes: a sheet-feed cover unit; a switch unit to be switched on or off depending on whether the sheet-feed cover unit is open or closed and including a first terminal, to which a first voltage, by which a driving motor is driven, is input, and a second terminal connected to the driving motor; and an open/close-detection circuit unit that includes a first switch circuit and a second switch circuit. The first switch circuit is switched on or off based on a threshold voltage that is larger than a second voltage to be generated in the driving motor by a jammed-document removing motion and smaller than the first voltage. The open/close-detection circuit unit detects that the sheet-feed cover unit is closed when the second switch circuit is energized, but detects that the sheet-feed cover unit is open when the second switch circuit is de-energized.

8 Claims, 9 Drawing Sheets

(56) References Cited

U.S. PATENT DOCUMENTS

| | | | | |
|---|---|---|---|---|
| 6,555,981 | B1 * | 4/2003 | Sun | 318/459 |
| 2004/0240898 | A1 * | 12/2004 | Nonaka et al. | 399/33 |
| 2006/0159482 | A1 * | 7/2006 | Okada | 399/88 |
| 2010/0054790 | A1 * | 3/2010 | Inukai | 399/88 |
| 2011/0076046 | A1 * | 3/2011 | Oh | 399/88 |
| 2012/0076513 | A1 * | 3/2012 | Fujita | 399/16 |
| 2014/0125007 | A1 * | 5/2014 | Sakano et al. | 271/265.01 |
| 2014/0186060 | A1 * | 7/2014 | Tashiro | 399/21 |

FOREIGN PATENT DOCUMENTS

| | | | | | |
|---|---|---|---|---|---|
| JP | 2005-221772 | | | 8/2005 | |
| JP | 2005221772 | A | * | 8/2005 | G03G 21/00 |
| JP | 2006184329 | A | * | 7/2006 | |
| JP | 2007140044 | A | * | 6/2007 | |
| JP | 2007206462 | A | * | 8/2007 | |

* cited by examiner

AUTOMATIC DOCUMENT FEEDER AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2012-121163 filed in Japan on May 28, 2012.

BACKGROUND OF THE INVENTION

1. Field of the Invention

The present invention generally relates to an automatic document feeder (ADF) and an image forming apparatus including the ADF, and, more particularly, to an ADF that automatically conveys original document medium (sheets) one sheet by one sheet from a stack of the original document placed on a document tray, and an image forming apparatus, such as a facsimile, a copier, or a multifunction peripheral, including the ADF.

2. Description of the Related Art

This type of ADF includes, as a driving source, an alternating-current (AC) motor that runs on alternating current or a direct-current (DC) motor that runs on direct current. DC motors consume less electric power than AC motors. Accordingly, ADFs that use DC motors rather than AC motors as driving source to reduce power consumption have become widespread.

DC motors differ from AC motors in that, when placed in a runaway state in which a motor rotates in an uncontrolled manner against a control command, loss of synchronization, which is slowdown or stopping of the motor resulting from a difference between a synchronization speed and an actual rotation speed, is less likely occur. For this reason, a countermeasure against runaway is generally taken for a DC motor.

Examples of the countermeasure include providing a switch such as an interlock switch or an interrupter in an ADF and interrupting power supply to a DC motor when occurrence of runaway is predicted.

In an ADF, paper jam can occur because an original document being conveyed is jammed into a component such as a conveying roller due to a type, such as size, a thickness, or a material, of the document, a bent or the like state of the document, or because the document is stapled. When jam occurs, a user generally performs what is referred to as jam recovery by opening a sheet feed cover of the ADF and removing a jammed document. An ADF typically includes an open/close detection sensor that detects whether the sheet feed cover is open or closed and is configured to prevent the ADF from operating during the jam recovery by interrupting power supply to a driving source of the ADF when the open/close detection sensor detects that the sheet feed cover is open. In some ADFs, the interlock switch described above combines a function of performing open/close detection of the sheet feed cover and a function of switching on and off the power supply. Such an interlock switch allows a user to perform jam recovery safely by, when the sheet feed cover of the ADF is opened by the user, interrupting power supply at the same instant when the sheet feed cover is detected as being open.

However, such an interlock switch that combines the two functions is disadvantageous in that a motion produced by a user when pulling out a jammed document rotates a conveying roller, which in turn rotates a motor.

When the motor is rotated, the rotation induces an electromotive force in the motor, causing the motor to function as a generator. As a result, a voltage in a detection circuit that detects whether the sheet feed cover is open or closed can rise to reach a detection voltage. This can lead to false detection that the sheet feed cover is detected as being closed even though the sheet feed cover is open.

Japanese Patent Application Laid-open No. 2003-323086 discloses an example of a conventional image forming apparatus including an ADF that prevents this type of false detection. The image forming apparatus includes a control unit that requires at least two power sources that are independent from one another, a driving unit that drives a load according to a command fed from the control unit, an interlock switch arranged on a driving power-source line through which driving power source is supplied from the control unit to the driving unit, and a backflow preventer diode arranged on a control power-source line through which control power source is supplied from the control unit to the driving unit.

This ADF is configured in such a manner that, when a user opens a door (a sheet feed cover) to perform jam recovery to remove jammed paper or the like, the interlock switch is switched off, and power supply is automatically turned off. The ADF is also configured in such a manner that, when the door is closed, the interlock switch is switched on, and the power supply is automatically turning on. When the power supply is turned on, a transient large current, which is generally referred to as an inrush current, back flows into the control power-source line, which can be a cause of malfunction of the interlock switch.

However, in this ADF, the backflow preventer diode provided on the control power-source line blocks backflow of the inrush current; accordingly, malfunction in on-off switching of the interlock switch is prevented.

Although the conventional ADF described above is configured to solve the malfunction of the interlock switch resulting from the inrush current, the ADF is not configured to solve a problem of malfunction of the interlock switch that combines the function of performing open/close detection of the sheet feed cover and the function of switching on and off the power supply. Accordingly, a challenge of preventing malfunction of the interlock switch that combines the two function is not solved yet, which is a problem.

Whereas the conventional ADF can prevent malfunction in on-off switching of the interlock switch by blocking the backflow of the inrush current, the conventional ADF is insufficiently capable of solving the malfunction in on/off detection of the sheet feed cover described above. Specifically, when a motor is rotated during jam recovery, a voltage in the detection circuit that detects open/close of the sheet feed cover can rise to reach a detection voltage as already described above. Thus, there is a problem that the challenge of preventing false detection of the interlock switch during jam recovery is not solved yet.

In view of the problem, there exists a need for providing an ADF capable of preventing an interlock switch, which combines a function of switching on and off power supply to a driving component and a function of performing open/close detection of a sheet feed cover, from making false detection in open/close detection of the sheet feed cover.

SUMMARY OF THE INVENTION

It is an object of the present invention to at least partially solve the problems in the conventional technology.

According to the present invention, there is provided: an automatic document feeder that conveys original document sheets placed on a document tray unit one sheet by one sheet on power from a driving motor, the automatic document feeder comprising: a sheet-feed cover unit configured to be operable to be opened and closed to allow removal of a jammed document at an occurrence of document jam; a switch unit configured to include a first terminal, to which a first voltage, by which the driving motor is driven, is input, and a second terminal connected to the driving motor, the first terminal and the second terminal being switched on when the sheet-feed cover unit is in a closed state, and the terminals being switched off when the sheet-feed cover unit is in an open state; and an open/close-detection circuit unit configured to detect whether the sheet-feed cover unit is in the open state or in the closed state.

In the above-mentioned automatic document feeder, the open/close-detection circuit unit includes a first switch circuit configured to be connected to the second terminal of the switch unit, and a second switch circuit configured to be connected to the first switch circuit so as to be switched on when the first switch circuit is on, and be switched off when the first switch circuit is off, the first switch circuit is switched on or off based on a threshold voltage that is larger than a second voltage to be generated in the driving motor by a motion of removing the jammed document and smaller than the first voltage, and the open/close-detection circuit unit detects that the sheet-feed cover unit is in the closed state when the second switch circuit is on, and detects that the sheet-feed cover unit is in the open state when the second switch circuit is off.

The invention also provides an image forming apparatus comprising an automatic document feeder that conveys original document sheets placed on a document tray unit one sheet by one sheet on power from a driving motor, wherein the automatic document feeder comprises: a sheet-feed cover unit configured to be operable to be opened and closed to allow removal of a jammed document at an occurrence of document jam; a switch unit configured to include a first terminal, to which a first voltage, by which the driving motor is driven, is input, and a second terminal connected to the driving motor, the first terminal and the second terminal being switched on when the sheet-feed cover unit is in a closed state, and the terminals being switched off when the sheet-feed cover unit is in an open state; and an open/close-detection circuit unit configured to detect whether the sheet-feed cover unit is in the open state or in the closed state In the above-mentioned image forming apparatus, the open/close-detection circuit unit includes a first switch circuit configured to be connected to the second terminal of the switch unit, and a second switch circuit configured to be connected to the first switch circuit so as to be switched on when the first switch circuit is on, and be switched off when the first switch circuit is off, the first switch circuit is switched on or off based on a threshold voltage that is larger than a second voltage to be generated in the driving motor by a motion of removing the jammed document and smaller than the first voltage, and the open/close-detection circuit unit detects that the sheet-feed cover unit is in the closed state when the second switch circuit is on, and detects that the sheet-feed cover unit is in the open state when the second switch circuit is off.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described below with reference to the accompanying drawings. An image forming apparatus including an automatic document feeder (ADF) according to one embodiment is embodied as a copier 1.

Figure 1:
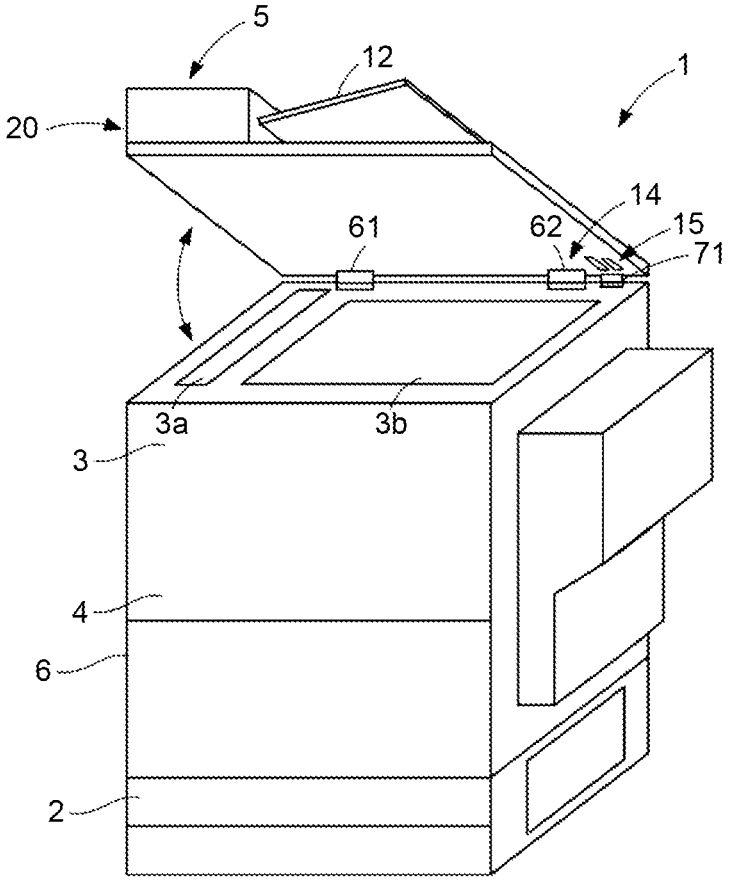
FIG. 1 is a perspective view illustrating an entire copier including an ADF according to an embodiment of the present invention.

As illustrated in FIG. 1, the copier 1 includes a paper feed device 2, an image scanning device 3, an image recording device 4, an ADF 5, and a housing 6 that houses therein these components.

The paper feed device 2 is configured to perform what is referred to as paper feeding, or, more specifically, supplying sheets of recording paper. The paper feed device 2 includes a paper cassette and a sheet-feed conveying mechanism, which are not illustrated. The paper cassette is configured to store recording paper of different sheet sizes. The sheet-feed conveying mechanism that includes conveying rollers is configured to convey the recording paper stored in the paper cassette to an image forming position of the image recording device 4.

The image scanning device 3 includes a slit glass 3*a*, an exposure glass 3*b*, a carriage (not shown) on which a light source and a mirror are mounted, an imaging lens (not shown), and an image capturing unit (not shown). The image scanning device 3 is configured to operate as follows: the light source of the carriage emits light through the slit glass 3*a* onto an original document being conveyed by the ADF 5; the mirror of the carriage redirects light reflected from the document; the imaging lens forms an image with the redirected reflection light; the image capturing unit reads in the image.

The image recording device 4 includes an exposure unit, a photosensitive drum, a developing unit, a transfer belt, and a fixing unit, which are not illustrated. The image recording device 4 is configured to operate as follows: the exposure unit forms a latent image on the photosensitive drum by exposing the photosensitive drum according to the read image read by the image capturing unit of the image scanning device 3; the developing unit develops the latent image by supplying toner of different colors onto the photosensitive drum. The image recording device 4 is configured to operate as follows: the transfer belt transfers the image developed on the photosensitive drum onto recording paper fed from the paper feed device 2; thereafter, the fixing unit fuses toner of the toner image transferred onto the recording paper, thereby fixing a color image onto the recording paper.

Figure 2:
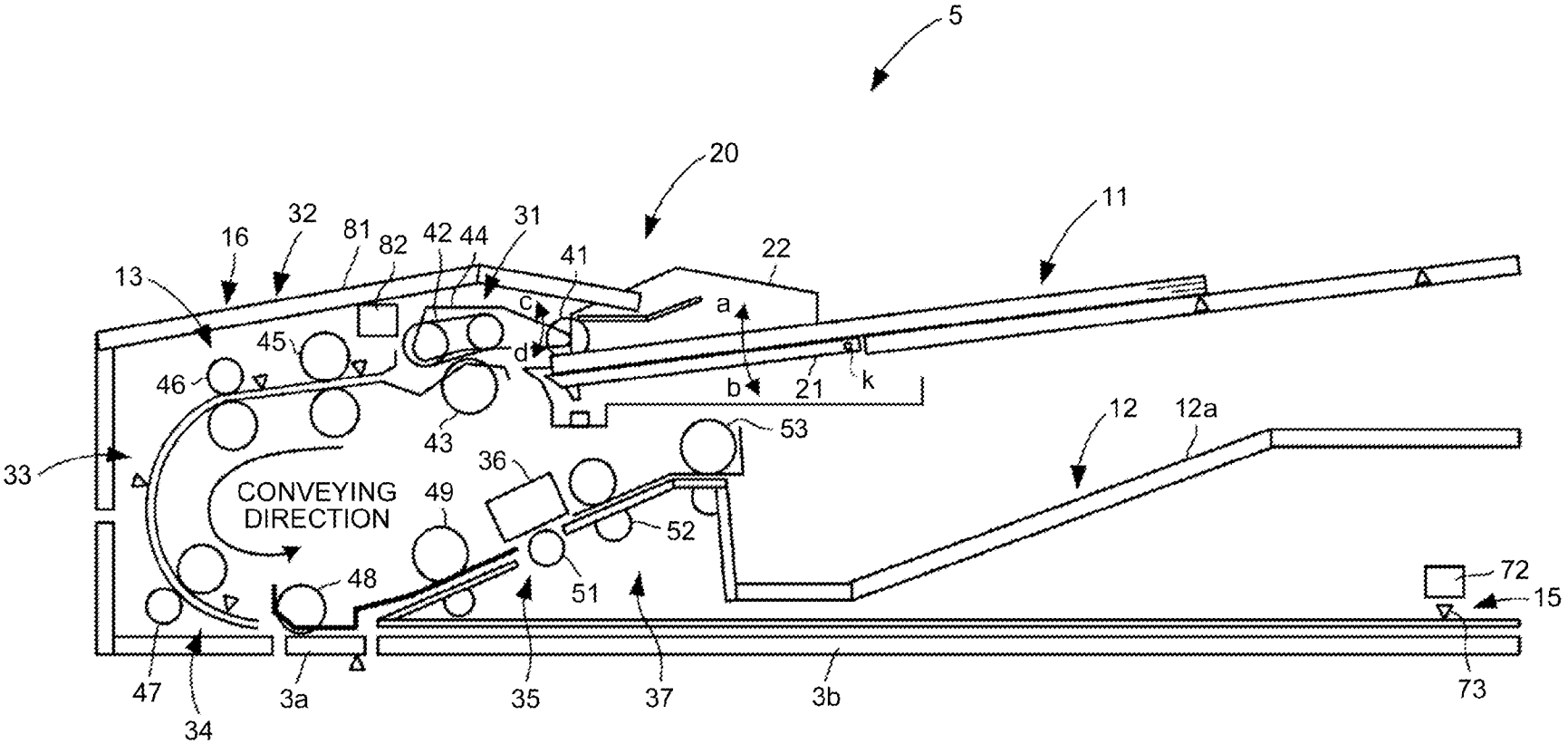
FIG. 2 is a schematic cross-sectional view of the ADF according to the embodiment.

As illustrated in FIG. 2, the ADF 5 includes a pressure plate unit 20, an open/close mechanism unit 14 that opens and closes the pressure plate unit 20, an open/close detecting unit 15, a sheet-feed cover unit 16, and an open/close-detection circuit unit 17. The pressure plate unit 20 includes a document tray unit 11 on which an original document is to be placed, a document-output tray unit 12 on which an original document that is output or, in short, an output document, is to be placed, a document conveying unit 13 that conveys the document, and driver motors (not shown) for driving respective components. The pressure plate unit 20 is a plate-like portion of components that face the exposure glass 3*b* and configured to press a book or a document to be scanned into contact with the exposure glass 3*b*.

The ADF 5 is configured to operate as follows: a document placed on the document tray unit 11 is automatically conveyed by the document conveying unit 13 onto the slit glass 3*a*; the document is scanned by the image recording device 34 through the slit glass 3*a*; thereafter, the document is output to be placed on the document-output tray unit 12.

The ADF 5 is attached via the open/close mechanism unit 14 to the image recording device 34 to be operable to be opened and closed relative to the image recording device 34.

In the copier 1, the ADF 5 is configured to automatically convey an original document as described above. Furthermore, the copier 1 has a function of scanning a document that is not conveyed but directly placed on the exposure glass 3*b* of the image scanning device 3 and fixed by closing the ADF 5. However, the function of scanning a fixed document does not have much relation with the present invention, and description about the function is omitted.

The document tray unit 11 includes a movable document table 21, and a pair of side guides 22 arranged on left and right sides of the document tray unit 11 with respect to a document conveying direction. The movable document table 21 is substantially a front half portion of the document tray unit 11 in the sheet feed direction. The movable document table 21 is configured so as to adjust a front end of a document on the document tray unit 11 in the document conveying direction to an appropriate height by pivoting in a direction indicated by arrow a or b in FIG. 2 about a pivot point, which is a basal end k.

The side guides 22 are configured to position right and left sides of the document on the document tray unit 11 with respect to the document conveying direction. One of the pair of side guides 22 is configured to be slidable in the left-right direction with respect to the conveying direction so that documents of different sizes can be placed on the document tray unit 11.

The document-output tray unit 12 includes a tray 12*a* arranged below the document tray unit 11 so that document sheets conveyed and output by the document conveying unit 13 are sequentially overlaid on one another to be stacked on the tray 12*a*.

The document conveying unit 13 includes a separating-and-feeding unit 31, a pull-out unit 32, a turnover unit 33, a first scan-conveying unit 34, a second scan-conveying unit 35, a scanning unit 36, and a sheet output unit 37.

The separating-and-feeding unit 31 includes a pickup roller 41, a sheet feed belt 42, a reverse roller 43, and a support arm 44. The pickup roller 41 is supported by the support arm 44 and configured to move up and down via a cam mechanism (not shown) in directions indicated by arrows c and d in FIG. 2 between a contact position where the pickup roller 41 contacts a document stack and a distant position where the pickup roller 41 is separated from the document stack. The pickup roller 41 is configured to pick up the document sheets on the document tray unit 11 one sheet by one sheet at the contact position.

The sheet feed belt 42 that rotates in the conveying direction is configured to be capable of pivoting up and down between a contact position where the sheet feed belt 42 contacts the reverse roller 43 and a distant position where the sheet feed belt 42 is separated from the reverse roller 43. The reverse roller 43 is configured to rotate in a direction opposite to the conveying direction. In a case of multiple feed or, more specifically, when multiple document sheets overlaid on one another are fed, the reverse roller 43 rotates in the opposite direction; whereas when the reverse roller 43 is in contact with the sheet feed belt 42 or when only one document sheet is conveyed, a torque limiter (not shown) is activated to cause the reverse roller 43 to be rotated by the sheet feed belt 42. Thus, multiple feed of the document is prevented.

The pull-out unit 32 includes a pair of pull-out rollers 45 sandwiching a conveying path therebetween. The pull-out unit 32 is configured to perform primary alignment (which is generally referred to as skew correction) on a delivered document by utilizing drive timing of the pull-out rollers 45 and the pickup roller 41, and pull out and convey the aligned document. The pull-out rollers 45 are configured to convey a document separated from a document stack toward the slit glass 3*a* of the image scanning device 3.

The turnover unit 33 includes a curved conveying path, which is a part of the conveying path, that is curved downward. The turnover unit 33 also includes a pair of intermediate rollers 46 and a pair of scan entry rollers 47, each pair of which sandwiches the curved conveying path therebetween. The turnover unit 33 is configured to turn over the document pulled out and conveyed by the intermediate rollers 46 by conveying the document along the curved conveying path, and convey the document, using the scan entry rollers 47, with its front side face down to near the slit glass 3*a*.

The first scan-conveying unit 34 includes a scanning roller 48 arranged at a position where the scanning roller 48 faces the slit glass 3*a* across the conveying path, and a pair of scan exit rollers 49 sandwiching the conveying path, along which scanned documents are to be conveyed, therebetween. The first scan-conveying unit 34 is configured to operate as follows: the scanning roller 48 conveys the document that has been conveyed to near the slit glass 3*a* while maintaining contact between the front side of the document and the slit glass 3*a*; the scan exit rollers 49 further convey the scanned document.

The second scan-conveying unit 35 includes a scanning roller 51 arranged at a position where the scanning roller 51 faces the scanning unit 36 across the conveying path, and a pair of scan exit rollers 52 arranged downstream of the scanning unit 36 in the conveying direction. The second scan-conveying unit 35 is configured in such a manner that the scan exit rollers 52 convey the document passed through the scanning unit 36 toward the sheet output unit 37.

Figure 3:
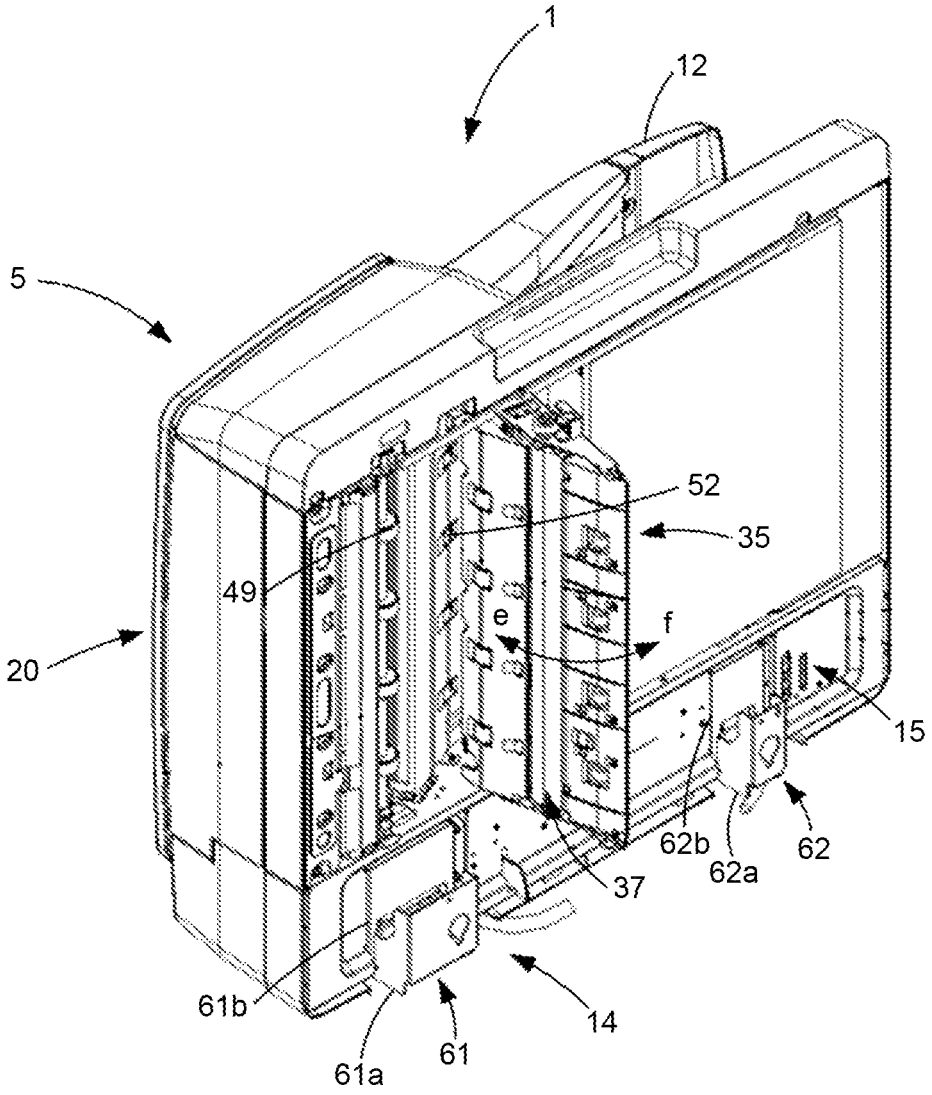
FIG. 3 is a perspective view illustrating the entire ADF according to the embodiment as viewed from a bottom side.

As illustrated in FIG. 3, the second scan-conveying unit 35 is configured to be operable to be opened and closed on a bottom side of the pressure plate unit 20 in directions indicated by arrows e and f in FIG. 3 about a rotation axis (not shown) when the pressure plate unit 20 is opened. This configuration allows a user to perform jam recovery when a document is jammed into a component, such as a roller of the first scan-conveying unit 34 or the second scan-conveying unit 35, by opening the second scan-conveying unit 35 into the open state illustrated in FIG. 3 and removing the jammed document.

The scanning unit 36 includes a contact image sensor (CIS) including a photoelectric transducer, such as a charge coupled device (CCD) or a complementary metal oxide semiconductor (CMOS). The scanning unit 36 is configured to perform duplex scanning; more specifically, the scanning unit 36 scans a back side of a document, of which front side has been scanned by the image scanning device 3 through the slit glass 3*a*. When duplex scanning is not to be performed, the document is caused to pass through the scanning unit 36 with no processing therein.

The sheet output unit 37 that includes a pair of sheet output rollers 53 is configured to output the document conveyed to the sheet output unit 37 by the scan exit rollers 52 onto the tray 12*a* of the document-output tray unit 12.

The driver motors are a plurality of motors, e.g., DC motors, that drive components of the ADF 5. Each of the driver motors is connected to a controller (not shown).

The driver motors include a pickup up-and-down motor, a pickup conveying motor, a sheet feed motor, a scanning motor, a sheet output motor, a bottom-plate lifting motor, a pull-out motor, a scan entry moter, and a cam driving motor, which are not illustrated. The bottom-plate lifting motor is configured to lift and lower the movable document table 21. The pickup up-and-down motor is configured to move up and down the pickup roller 41. Each of the other motors are configured to rotate a corresponding roller to convey a document according to a command fed from the controller. The controller is connected to each of sensors arranged near the respective rollers and configured to control the motors based on information output from the sensors.

As illustrated in FIGS. 1 and 3, the open/close mechanism unit 14 includes a first hinge 61 and a second hinge 62.

As illustrated in FIG. 3, the first hinge 61 includes a housing fixing piece 61*a* fixed onto the housing 6, a pressure-plate-unit fixing piece 61*b* formed in one piece with the housing fixing piece 61*a* and fixed onto the pressure plate unit 20, and a compression coil spring (not shown). The compression coil spring is housed in the pressure-plate-unit fixing piece 61*b* and set so as to make it possible to maintain an angle between the pressure plate unit 20 and the exposure glass 3*b* of the image scanning device 3 at a desired angle when the pressure plate unit 20 is opened.

As does the first hinge 61, the second hinge 62 includes a housing fixing piece 62*a* fixed onto the housing 6, a pressure-plate-unit fixing piece 62*b* formed in one piece with the housing fixing piece 62*a* and fixed onto the pressure plate unit 20, and a compression coil spring (not shown). As is the first hinge 61, the compression coil spring is housed in the pressure-plate-unit fixing piece 62*b* and set so as to make it possible to maintain the angle between the pressure plate unit 20 and the exposure glass 3*b* of the image scanning device 3 at the desired angle in cooperation with the first hinge 61 when the pressure plate unit 20 is opened.

Figure 4:
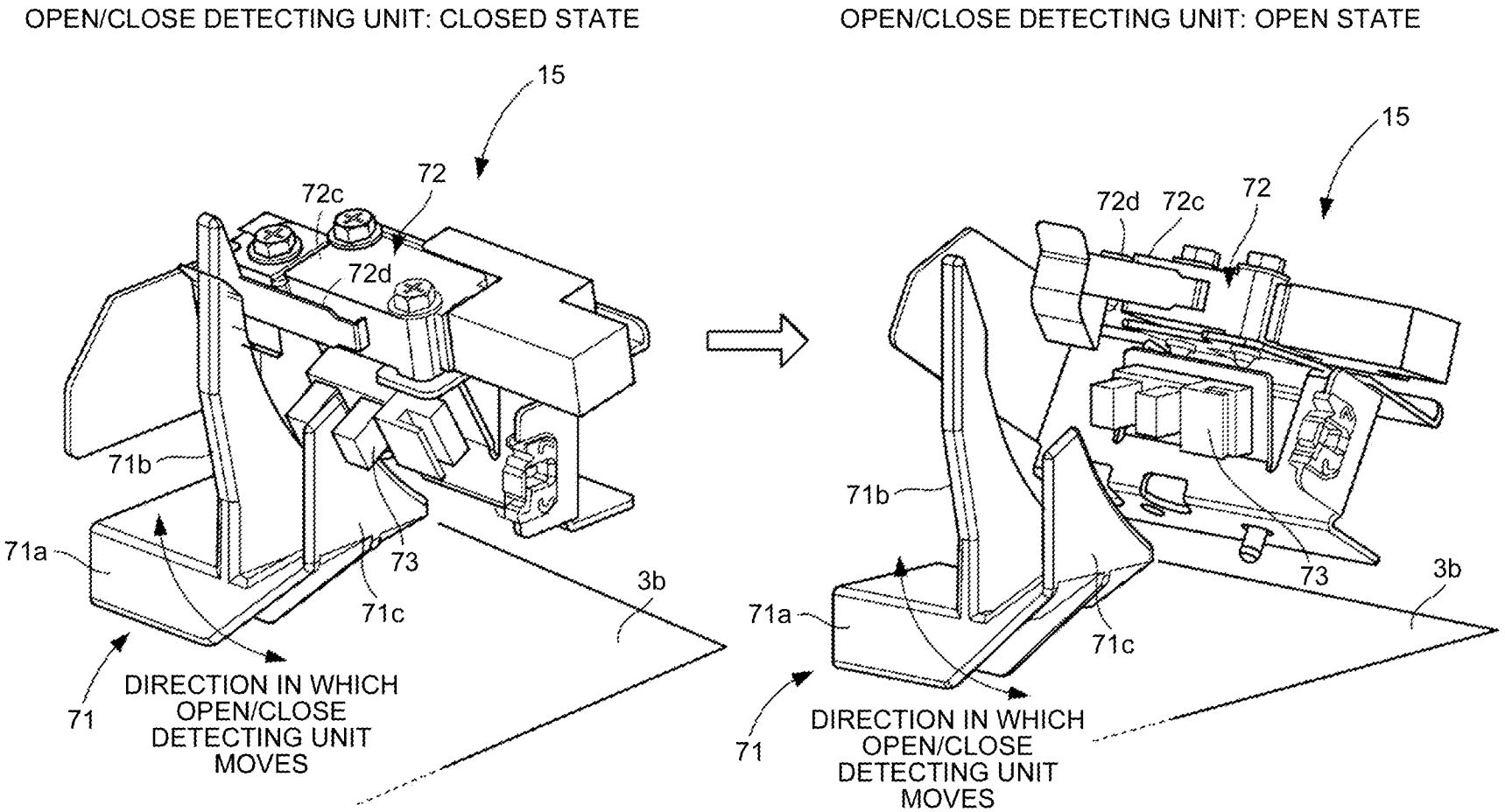
FIG. 4 is perspective view illustrating configurations of a pressure-plate-unit interlock switch and a pressure-plate-unit open/close-detection sensor of the ADF according to the embodiment, in which (a) illustrates a state where a blocking plate is blocking, and (b) illustrates a state where the blocking plate is withdrawn.

As illustrated in FIG. 4, the open/close detecting unit 15 includes a plate 71, a pressure-plate-unit interlock switch 72, and a pressure-plate-unit open/close detection sensor 73.

The plate 71 includes a base plate 71*a* fixed onto the housing 6, a pressing plate 71*b* projecting from the base plate 71*a* toward the pressure plate unit 20, and a blocking plate 71*c* projecting from the base plate 71*a* toward the pressure plate unit 20 and isolated from the pressing plate 71*b*. The pressing plate 71*b* is to come into pressure contact with the pressure-plate-unit interlock switch 72.

As illustrated in (a) of FIG. 4, the pressing plate 71*b* is configured to come into pressure contact with the interlock switch 72 when the pressure plate unit 20 is closed; the blocking plate 71*c* is configured to block the open/close detection sensor 73 when the pressure plate unit 20 is closed.

The interlock switch 72 and the open/close detection sensor 73 are configured to operate concurrently with each other in response to opening and closing of the pressure plate unit 20. More specifically, at the same time when the pressing plate 71*b* comes into pressure contact with the interlock switch 72, the blocking plate 71*c* blocks the open/close detection sensor 73. Similarly, at the same time when the pressing plate 71*b* is released from the pressure contact with the interlock switch 72, the blocking plate 71*c* withdraws from blocking the open/close detection sensor 73.

Figure 5:
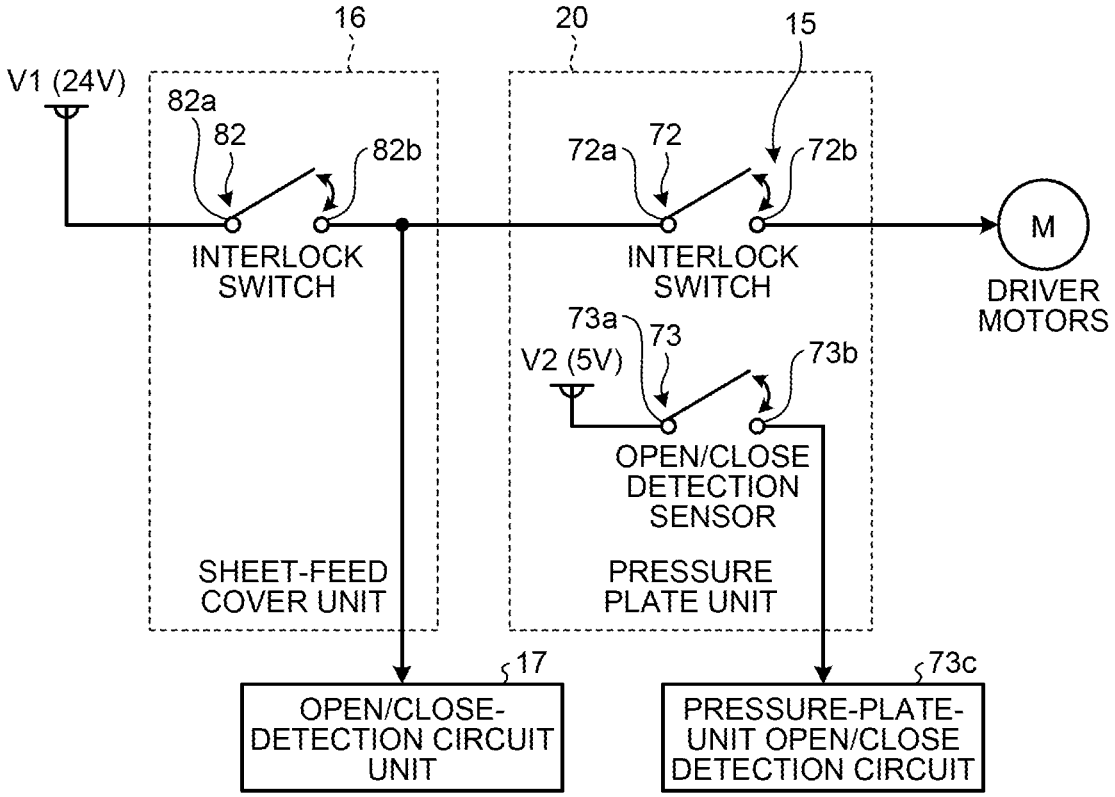
FIG. 5 is an explanatory diagram of open/close detection by the pressure-plate-unit interlock switch and a sheet-feed-unit interlock switch of the ADF according to the embodiment.

As illustrated in FIG. 5, the interlock switch 72 is a switch that switches on and off connection between a terminal 72*a* on the power supply side (hereinafter, "the power supply terminal 72*a*") and a terminal 72*b* on the driving motor side (hereinafter, "the driving-motor terminal 72*b*"). The power supply terminal 72*a* is connected via an interlock switch 82, which will be described later, to a power source, e.g., a 24-volt DC, by which the driver motors are driven. The driving-motor terminal 72*b* is connected to the driver motors.

As illustrated in FIG. 4, the interlock switch 72 includes a casing 72*c* accommodating the terminals 72*a* and 72*b* and fixed to the pressure plate unit 20, an arm 72*d* which is an elastic member and fixed at one end thereof to the casing 72*c*, and a contact member.

The interlock switch 72 is configured to operate, as illustrated in (a) of FIG. 4, in such a manner that when the pressure plate unit 20 is closed to enter a closed state, the arm 72*d* comes into pressure contact with the pressing plate 71*b* of the plate 71, causing the contact member to switch on. The interlock switch 72 is also configured to operate, as illustrated in (b) of FIG. 4, in such a manner that when the pressure plate unit 20 is opened to enter an open state, the arm 72*d* is released from the pressure contact with the pressing plate 71*b* of the plate 71, causing the contact member to switch off.

The open/close detection sensor 73, which can be a photodetector, such as a transmission photodetector, includes a terminal 73*a* on the power supply side (hereinafter, "the power supply terminal 73*a*"), a terminal 73*b* on the detection side (hereinafter, "the detection terminal 73*b*"), and a detection circuit 73*c*.

The open/close detection sensor 73 is configured to switch on and off connection between the power supply terminal 73*a* and the detection terminal 73*b* depending on whether or not the open/close detection sensor 73 is blocked by the blocking plate 71*c* of the plate 71.

The power supply terminal 73*a* is connected to a power source V2, e.g., a 5-volt DC. The detection terminal 73*b* is connected to the detection circuit 73*c*.

The detection circuit 73*c* is a circuit that detects whether the connection between the power supply terminal 73*a* and the detection terminal 73*b* is on or off. The detection circuit 73*c* includes, for instance, a detecting device, such as a voltmeter or an ammeter, that detects whether an electric current is passing through between the power supply terminal 73*a* and the detection terminal 73*b*.

Figure 6:
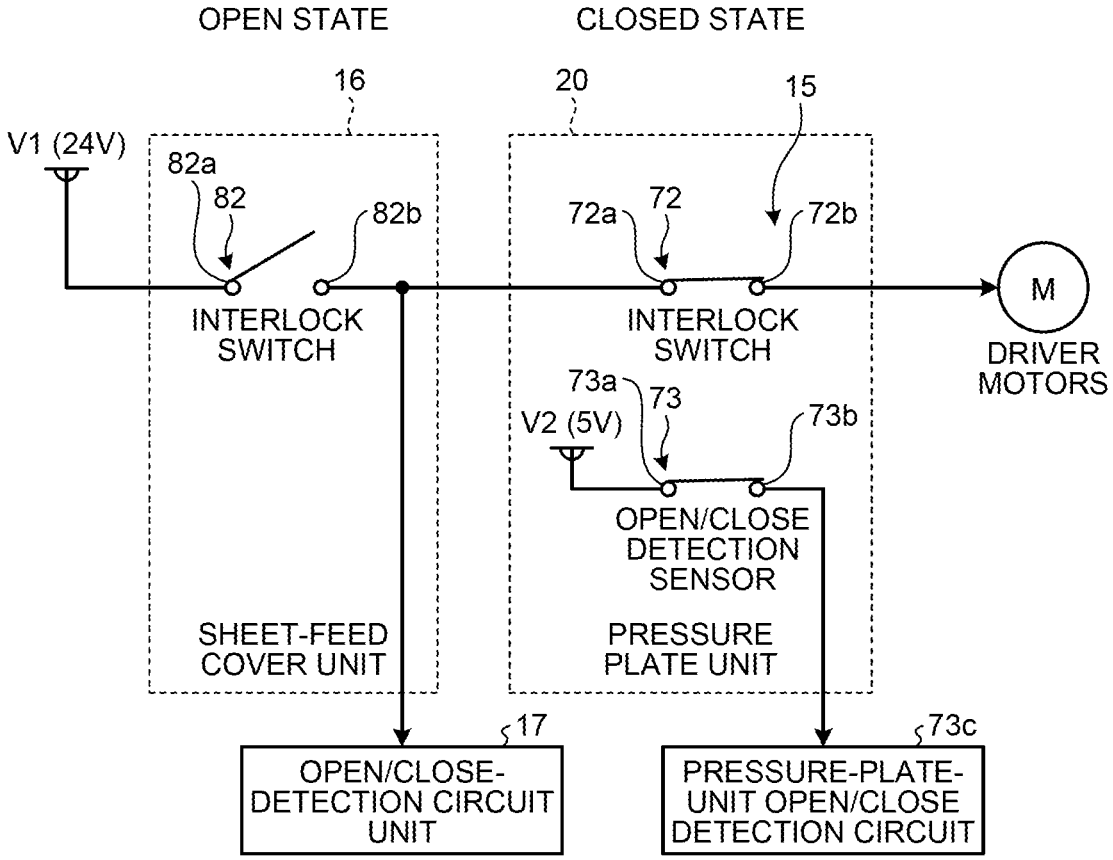
FIG. 6 is an explanatory diagram of false open/close detection by the sheet-feed-unit interlock switch of the ADF according to the embodiment.

The power source V2, which is the 5-volt DC, is supplied to the terminal 73*a*. Accordingly, the open/close detection sensor 73 is capable of detecting the open/close state of the pressure plate unit 20 even in a state where, as illustrated in FIG. 6, a first voltage V1, which is the 24-volt DC, is not supplied to the power supply terminal 72*a* of the interlock switch 72 with the interlock switch 82 switched off and the sheet-feed cover unit 16 in the open state.

The open/close detection sensor 73 is configured to detect that the pressure plate unit 20 is in the closed state when the pressure plate unit 20 is closed to enter the closed state and, as its consequence, the transmission photodetector is blocked by the blocking plate 71*c* as illustrated in (a) of FIG. 4. Similarly, the open/close detection sensor 73 is configured to detect that the pressure plate unit 20 is in the open state when the pressure plate unit 20 is opened to enter the open state and, as its consequence, the blocking plate 71*c* withdraws from blocking the transmission photodetector as illustrated in (b) of FIG. 4.

Figure 7:
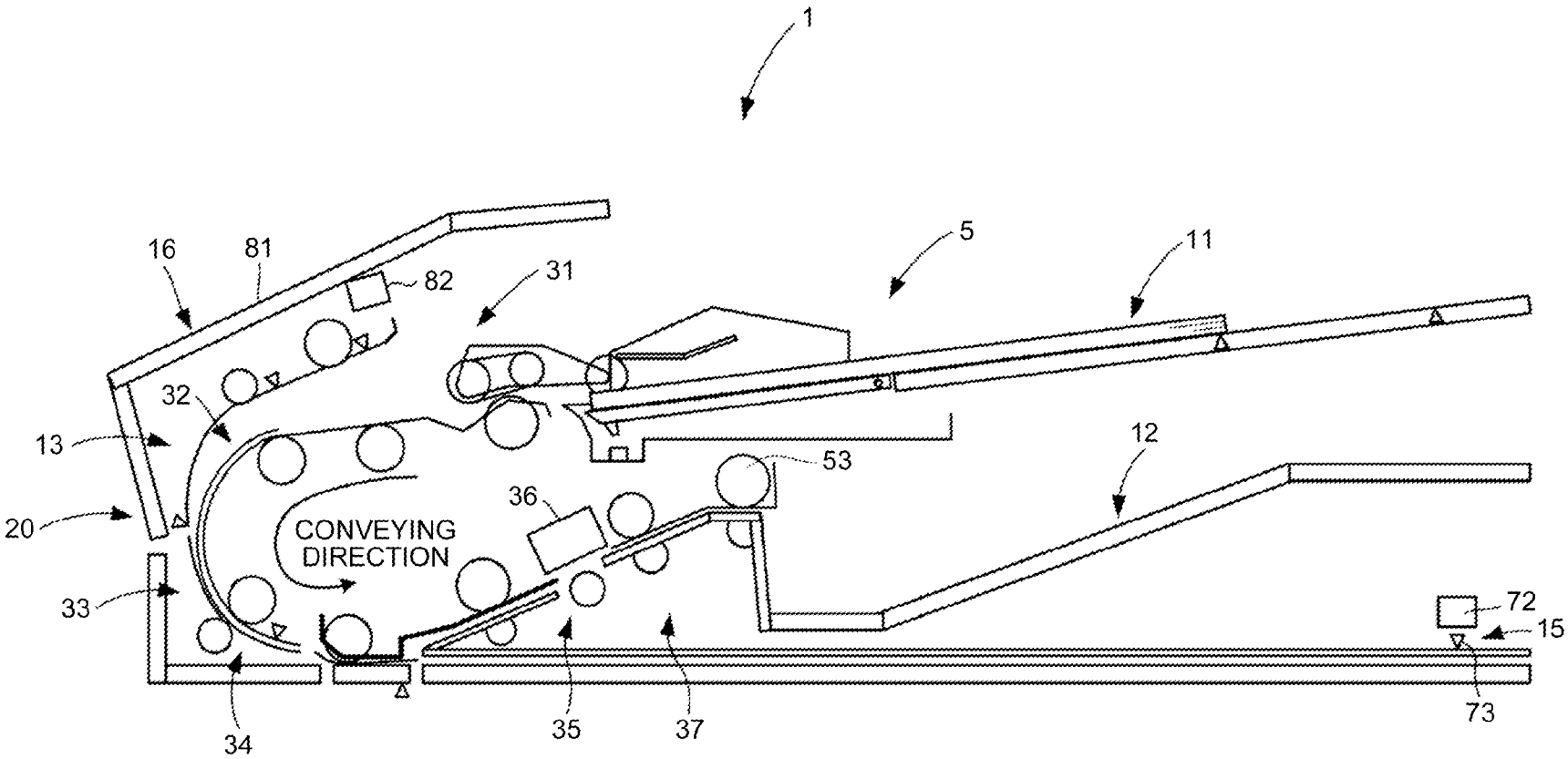
FIG. 7 is a schematic cross-sectional view of the ADF according to the embodiment in which a sheet feed cover is in an open state.

As illustrated in FIGS. 2 and 7, the sheet-feed cover unit 16 includes a sheet feed cover 81 and the interlock switch 82 arranged on an inner wall of the sheet feed cover 81.

The sheet feed cover 81 includes a plate member, a grip (not shown), and an open/close mechanism (not shown). The plate member covers the separating-and-feeding unit 31, the pull-out unit 32, and the turnover unit 33. The sheet feed cover 81 is configured to allow a user to perform jam recovery when a document being conveyed is jammed into a component, such as a roller of the separating-and-feeding unit 31, the pull-out unit 32, or the turnover unit 33, by opening the sheet feed cover 81 and removing the jammed document.

As illustrated in FIGS. 5 and 6, the interlock switch 82 is a switch that switches on and off connection between a terminal 82*a* on the power supply side (hereinafter, "the power supply terminal 82*a*") and a terminal 82*b* on the driving motor side (hereinafter, "the driving-motor terminal 82*b*") according to on or off of the sheet feed cover 81. The power supply terminal 82*a* is connected to the first voltage V1, e.g., the 24-volt DC, by which the driver motors are driven. The driving-motor terminal 82*b* is connected to the driver motors via the interlock switch 72.

The interlock switch 82 is an interlock switch that includes a housing member, an arm member, and a pressing member, which are not illustrated.

The arm member includes an arm, which is an elastic member and connected at one end to the housing member.

The pressing member is fixed to the pressure plate unit 20 on a side where the pressure plate unit 20 faces the sheet feed cover 81 when the sheet feed cover 81 is in the open state, and configured to press the arm when the sheet feed cover 81 is in the closed state.

The interlock switch 82 is configured to operate in the following manner: when the sheet feed cover 81 is closed to enter the closed state as illustrated in FIG. 2, the arm is brought into pressure contact with the pressing member; and the connection between the power supply terminal 82*a* and the driving-motor terminal 82*b* is switched on, causing the power source to be supplied. Similarly, the interlock switch 82 is configured to operate in the following manner: when the sheet feed cover 81 is opened to enter the open state as illustrated in FIG. 7, the arm is released from the pressure contact with the pressing member; and the connection between the power supply terminal 82*a* and the driving-motor terminal 82*b* is switched off, causing the power supply to be interrupted.

The interlock switch 82 according to the present embodiment is an example of a switch unit according to an aspect of the present invention. The power supply terminal 82*a* according to the present embodiment is an example of a first terminal to which the first voltage, by which a driving motor according to an aspect of the present invention is driven, is input. The driving-motor terminal 82*b* according to the present embodiment is an example of a second terminal connected to the driving motor according to the aspect of the present invention.

Figure 8:
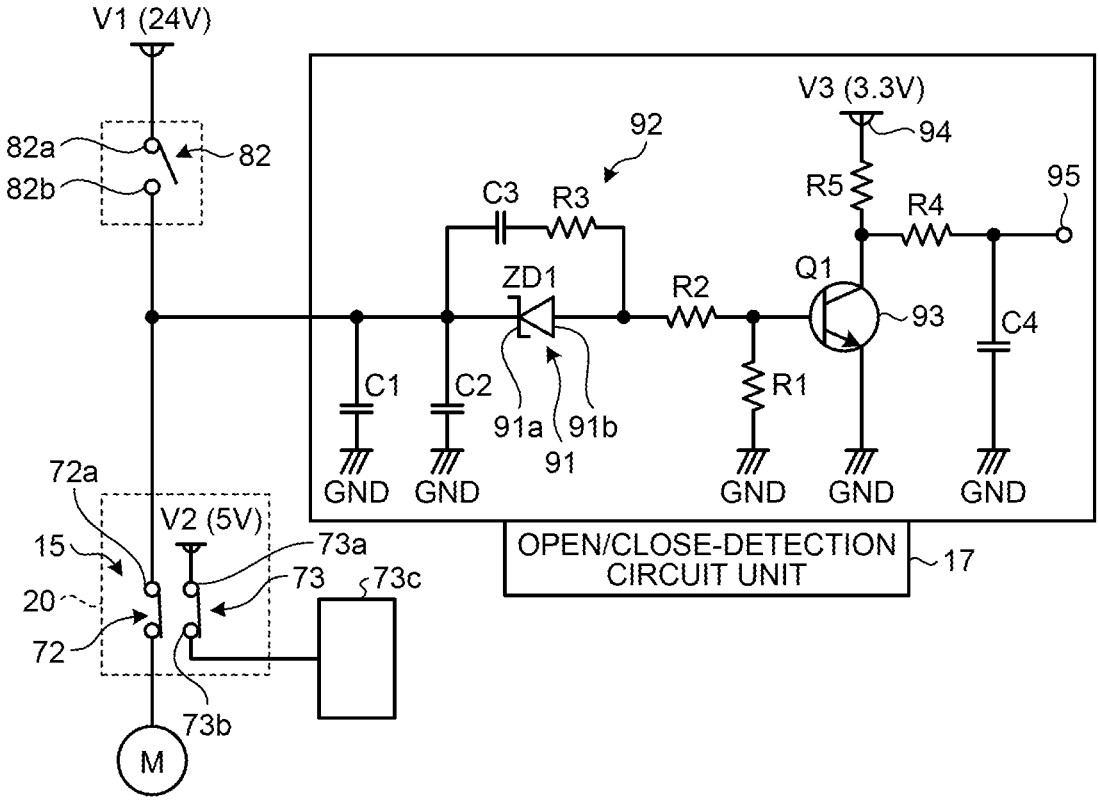
FIG. 8 is a configuration diagram illustrating a circuit configuration in which the interlock switches of the ADF according to the embodiment combine a function of switching on and off power supply and a function of open/close detection of the sheet feed cover.

As illustrated in FIG. 8, the open/close-detection circuit unit 17 includes a zener diode 91, a snubber circuit 92, a transistor 93, a power source 94, and a terminal 95, and is configured to detect the open/close state of the sheet-feed cover unit 16.

Constituent devices of the open/close-detection circuit unit 17 are mounted on a portion of a printed circuit board (not shown) in the ADF 5.

The zener diode 91 according to the present embodiment is an example of a first switch circuit according to an aspect of the present invention. The transistor 93 according to the present embodiment is an example of a second switch circuit according to an aspect of the present invention.

The zener diode 91 includes a cathode 91*a* and an anode 91*b*. The zener diode 91 is configured to operate as follows by utilizing what is referred to as a zener voltage as a threshold voltage Vs: the zener diode 91 is energized when a voltage larger than the threshold voltage Vs is applied to the cathode 91*a*, whereas the zener diode 91 is de-energized when a voltage smaller than the threshold voltage Vs is applied to the cathode 91*a*.

Thus, the zener diode 91 has such a switching function of turning on at a voltage larger than the threshold voltage Vs, but turning off at a voltage smaller than the threshold voltage Vs.

The cathode 91*a* is connected to the terminal 82*b* of the interlock switch 82 and configured to be supplied with the first voltage V1, e.g., the 24-volt DC, when the interlock switch 82 is on.

The cathode 91*a* is connected via the interlock switch 72 to the driver motors that are driven by the first voltage V1.

There can occur a situation where, when a user of the ADF 5 opens the sheet-feed cover unit 16 to remove a jammed document, user's motion of removing the jammed document rotates a roller, which in turn rotates a driving motor coupled to the roller, resulting in that a voltage Vt, which is the second voltage, is generated in the driving motor. If the interlock switch 72 is on in this situation, the second voltage Vt is applied to the cathode 91*a*.

The second voltage Vt varies depending on specifications, such as a structure, a shape, and a size, of the sheet-feed cover unit 16 of the ADF 5 and the motion of removing the jammed document. The second voltage Vt is, for instance, several volts no larger than 10 volts.

A zener diode of which zener voltage, or the threshold voltage Vs, is 12 volts, for example, is used as the zener diode 91.

Accordingly, the zener diode 91 is energized and switched on when the 24-volt DC, which is the first voltage V1 by which the driver motors are driven, is applied to the cathode 91*a*, but de-energized and switched off when the second voltage Vt is applied to the cathode 91*a*.

Therefore, the zener diode 91 is not energized, or, put another way, not switched on, even when a voltage is generated in a driving motor by a motion of removing a jammed document.

The snubber circuit 92 includes a capacitor C3 and a resistor R3 connected to the capacitor C3 in series. The snubber circuit 92 is arranged in shunt with the zener diode 91 in such a manner that one end of the capacitor C3 is connected to the cathode 91*a* of the zener diode 91, and one end of the resistor R3 is connected to the anode 91*b*.

This arrangement allows, when, for instance, a transient large current, which is generally referred to an inrush current, passes through the zener diode 91 at start of supplying the first voltage V1 in a condition where the interlock switch 82 is on, the inrush current to be absorbed by the snubber circuit 92, thereby protecting the zener diode 91.

The transistor 93 is an NPN transistor that includes a base, a collector, and an emitter, and connected at the base to the power source of the first voltage V1 via a resistor R2 and the interlock switch 82. The collector is connected to the power source 94 of a voltage V3, e.g., a 3.3-volt DC, via a resistor R5. The emitter is connected to the GND.

Accordingly, when the zener diode 91 is on with the interlock switch 82 on, the transistor 93 is on because the first voltage V1 is applied to the base via the resistor R2.

On the other hand, when the zener diode 91 is off, the transistor 93 is off because the first voltage V1 is not applied to the base. In other words, the transistor 93 functions as a switch that is turned on or off depending on whether or not the voltage is applied to the base.

The terminal 95 is connected to the power source 94 via a resistor R4 and the resistor R5, and connected to the GND via the resistor R4 and the transistor 93. The terminal 95 is also connected to a voltmeter (not shown) and configured to detect a voltage applied to the terminal 95.

Accordingly, when the transistor 93 is on, the voltmeter allows detecting that the transistor 93 is on because the voltage applied to the terminal 95 rises Hi. When the transistor 93 is off, the voltmeter allows detecting that the transistor 93 is off because the voltage applied to the terminal 95 falls Lo.

The open/close-detection circuit unit 17 configured as described above operate as follows: when the sheet-feed cover unit 16 enters the closed state and the interlock switch 82 is switched on, the zener diode 91 is switched on and the transistor 93 is switched on; accordingly, the open/close-detection circuit unit 17 detects that the sheet-feed cover unit 16 is in the closed state.

On the other hand, when the sheet-feed cover unit 16 enters the closed state and the interlock switch 82 is switched off, the zener diode 91 is switched off and the transistor 93 is switched off; accordingly, the open/close-detection circuit unit 17 detects that the sheet-feed cover unit 16 is in the open state.

As described above, the transistor 93 is maintained off even when the second voltage Vt is generated in the driving motor when the driving motor is rotated by user's motion of removing a jammed document with the sheet-feed cover unit 16 in the open state. This is because the zener diode 91 is not switched on. Thus, the sheet-feed cover unit 16 is not falsely detected as being in the closed state even when the second voltage Vt is generated in the driving motor.

Figure 9:
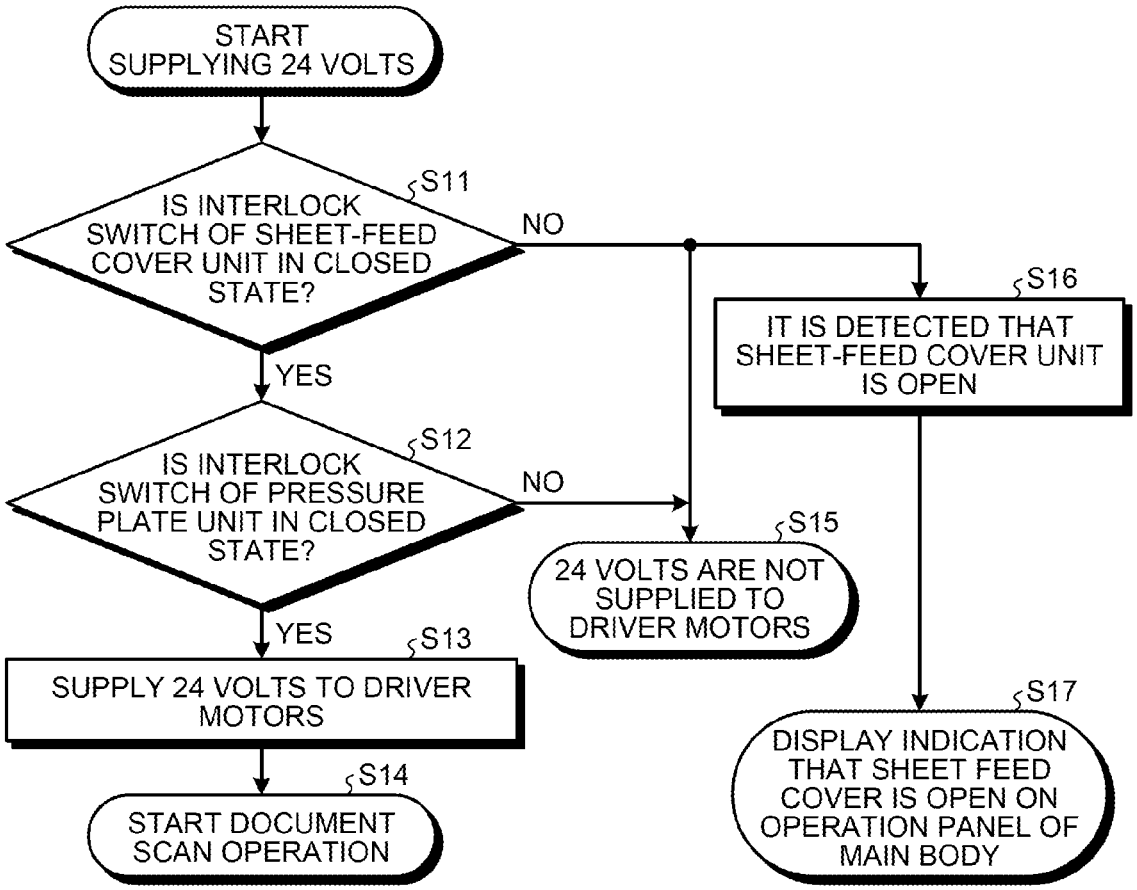
FIG. 9 is a flowchart for power supply to driving motors of the ADF according to the embodiment.

Operations for detecting the open/close states of the sheet-feed cover unit 16 and the pressure plate unit 20 in the ADF 5 are briefly described with reference to a flowchart illustrated in FIG. 9.

When supply of the first voltage V1, which is the 24-volt DC, is started at power-on of the ADF 5, the open/close-detection circuit unit 17 determines an on/off state of the interlock switch 82 of the sheet-feed cover unit 16 or, more specifically, whether the interlock switch 82 is on or off (Step S11). When it is determined that the interlock switch 82 is on and the sheet-feed cover unit 16 is closed, the open/close detection sensor 73 of the open/close detecting unit 15 determines the on/off state of the pressure plate unit 20 or, more specifically, the on/off state of the interlock switch 72 (Step S12). When it is determined that the interlock switch 72 is in the closed state and the pressure plate unit 20 is closed, the 24-volt DC is supplied to the driver motors (Step S13). Thereupon, a document scan operation is started (Step S14).

At the same instant when it is determined, at Step S11, that the interlock switch 82 is off and the sheet-feed cover unit 16 is open, supply of the 24-volt DC to the driver motors is stopped (Step S15). And, it is detected that the sheet-feed cover unit 16 is open (Step S16), and an indication that the sheet feed cover is open is displayed on an operation panel (not shown) of a main body of the ADF 5 (Step S17).

The ADF 5 according to the present embodiment is configured as described above as well as described below briefly and, accordingly, provides the after-mentioned advantage.

That is, the ADF 5 according to the embodiment includes: the sheet-feed cover unit 16 operable to be opened and closed to allow removal of a jammed document at an occurrence of document jam; the interlock switch 82; and the open/close-detection circuit unit 17 that detects the open/close state of the sheet-feed cover unit 16. The interlock switch 82 includes the terminal 82*a*, to which the 24-volt DC, by which the driver motors are driven, is input, and the terminal 82*b* connected to the driving motor. The interlock switch 82 is switched on when the sheet-feed cover unit 16 is in the closed state but switched off when the sheet-feed cover unit 16 is in the open state. The open/close-detection circuit unit 17 includes the zener diode 91 connected to the terminal 82*a*, and the transistor 93 connected to the zener diode 91 in such a manner as to be switched on when the zener diode 91 is energized but switched off when the zener diode 91 is de-energized. The ADF 5 is configured in the following manner: the zener diode 91 is switched on or off based on the threshold voltage Vs that is larger than the second voltage Vt, which is to be generated in a driving motor by a motion of removing a jammed document, and smaller than the first voltage V1; the sheet-feed cover unit 16 is detected as being in the closed state when the transistor 93 is energized, but detected as being in the open state when the transistor 93 is de-energized.

Because the ADF 5 is configured as described above, the ADF 5 according to the embodiment is capable of preventing the interlock switch 82 that combines the function of switching on and off power supply to driving components such as the driver motors and the function of detecting the open/close state of the sheet-feed cover unit 16 from making false open/close detection of the sheet-feed cover unit 16.

More specifically, because the open/close-detection circuit unit 17 includes the zener diode 91, the problem of false detection that can occur in open/close detection of conventional sheet-feed cover unit is solved.

As described above, there can occur a situation where, when a user of a conventional ADF opens a sheet-feed cover unit to remove a jammed original document, a motion of removing the jammed document rotates a roller, which in turn rotates a driving motor coupled to the roller, causing a voltage to be generated in the driving motor. This voltage is applied to a detection circuit that detects whether the conventional sheet-feed cover unit is open or closed, and can result in false detection that the sheet-feed cover unit is falsely detected as being closed even though the sheet-feed cover unit is open.

The zener diode 91 of the open/close-detection circuit unit 17 has, as its feature, the threshold voltage Vs which is a so-called zener voltage. The threshold voltage Vs is set to be larger than the second voltage Vt, which is to be generated in the driving motor by what is referred to as jam recovery performed by a user. Therefore, the zener diode 91 is not energized even when the second voltage Vt is applied. As a result, the false detection problem pertaining to conventional ADFs can be solved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automatic document feeder that conveys original document sheets placed on a document tray unit one sheet by one sheet on power from a driving motor, the automatic document feeder comprising:

a sheet-feed cover unit configured to be operable to be opened and closed to allow removal of a jammed document at an occurrence of document jam;

a switch unit configured to include a first terminal, to which a first voltage, by which the driving motor is driven, is input, and a second terminal connected to the driving motor, the first terminal and the second terminal being switched on when the sheet-feed cover unit is in a closed state, and the terminals being switched off when the sheet-feed cover unit is in an open state; and an open/close-detection circuit unit configured to detect whether the sheet-feed cover unit is in the open state or in the closed state, wherein the open/close-detection circuit unit includes a first switch circuit configured to be connected to the second terminal of the switch unit, and a second switch circuit configured to be connected to the first switch circuit so as to be switched on when the first switch circuit is on, and be switched off when the first switch circuit is off, the first switch circuit is switched on or off based on a threshold voltage that is larger than a second voltage to be generated in the driving motor by a motion of removing the jammed document and smaller than the first voltage, and the open/close-detection circuit unit detects that the sheet-feed cover unit is in the closed state when the second switch circuit is on, and detects that the sheet-feed cover unit is in the open state when the second switch circuit is off.

2. The automatic document feeder according to claim 1, wherein the first switch circuit is a zener diode that includes a cathode and an anode, the cathode being connected to the second terminal of the switch unit, and the anode being connected to the second switch circuit.

3. The automatic document feeder according to claim 1, further comprising:

a pressure plate unit configured to include the sheet-feed cover unit, the switch unit, and a document conveying unit that conveys the document sheets;

an open/close mechanism unit configured to open and close the pressure plate unit; and an interlock switch configured to be interposed between the switch unit and the driving motor and be connected to the switch unit in series, wherein the interlock switch is switched on when the pressure plate unit is closed, and is switched off when the pressure plate unit is open.

4. The automatic document feeder according to claim 3, wherein the switch unit is arranged at the sheet-feed cover unit, and the interlock switch is arranged at the open/close mechanism unit.

5. An image forming apparatus comprising an automatic document feeder that conveys original document sheets placed on a document tray unit one sheet by one sheet on power from a driving motor, wherein the automatic document feeder comprises:

a sheet-feed cover unit configured to be operable to be opened and closed to allow removal of a jammed document at an occurrence of document jam;

a switch unit configured to include a first terminal, to which a first voltage, by which the driving motor is driven, is input, and a second terminal connected to the driving motor, the first terminal and the second terminal being switched on when the sheet-feed cover unit is in a closed state, and the terminals being switched off when the sheet-feed cover unit is in an open state; and an open/close-detection circuit unit configured to detect whether the sheet-feed cover unit is in the open state or in the closed state, wherein the open/close-detection circuit unit includes a first switch circuit configured to be connected to the second terminal of the switch unit, and a second switch circuit configured to be connected to the first switch circuit so as to be switched on when the first switch circuit is on, and be switched off when the first switch circuit is off, the first switch circuit is switched on or off based on a threshold voltage that is larger than a second voltage to be generated in the driving motor by a motion of removing the jammed document and smaller than the first voltage, and the open/close-detection circuit unit detects that the sheet-feed cover unit is in the closed state when the second switch circuit is on, and detects that the sheet-feed cover unit is in the open state when the second switch circuit is off.

6. The image forming apparatus according to claim 5, wherein the first switch circuit is a zener diode that includes a cathode and an anode, the cathode being connected to the second terminal of the switch unit, and the anode being connected to the second switch circuit.

7. The image forming apparatus according to claim 5, wherein the automatic document feeder further comprises:

a pressure plate unit configured to include the sheet-feed cover unit, the switch unit, and a document conveying unit that conveys the document sheets;

an open/close mechanism unit configured to open and close the pressure plate unit; and an interlock switch configured to be interposed between the switch unit and the driving motor and be connected to the switch unit in series, wherein the interlock switch is switched on when the pressure plate unit is closed, and is switched off when the pressure plate unit is open.

8. The image forming apparatus according to claim 7, wherein the switch unit is arranged at the sheet-feed cover unit, and the interlock switch is arranged at the open/close mechanism unit.

* * * * *